United States Patent [19]

Kletch

[11] 4,346,753

[45] Aug. 31, 1982

[54] REGENERATOR CHECKERWORK BRICK

[75] Inventor: Stanley J. Kletch, Bridgeville, Pa.

[73] Assignee: Bricmont & Associates, Inc., McMurray, Pa.

[21] Appl. No.: 223,071

[22] Filed: Jan. 6, 1981

[51] Int. Cl.[3] ..... F28D 17/02

[52] U.S. Cl. ..... 165/9.1; 165/9.3; 165/9.4

[58] Field of Search ..... 165/9.1–9.4

[56] References Cited

FOREIGN PATENT DOCUMENTS 2529372 1/1977 Fed. Rep. of Germany ..... 165/9.1

941251 11/1963 United Kingdom ..... 165/9.3

*Primary Examiner*—Albert W. Davis

*Attorney, Agent, or Firm*—Thomas H. Murray; Clifford A. Poff

[57] ABSTRACT

Regenerator checkerbrick for a blast furnace stove system embody a hexagonal configuration. A central flow space for a heat exchange medium has six planar wall surfaces. An array of outer flow spaces each have six planar wall surfaces, one of which is parallel with a wall surface of the central flow space. All walls are uniformly thick and the external walls have a thickness about one-half the thickness of the internal walls.

5 Claims, 3 Drawing Figures

REGENERATOR CHECKERWORK BRICK

BACKGROUND OF THE INVENTION

This invention relates to a regenerator checkerwork brick having flow spaces in refractory material to store and recover heat. More particularly, the present invention relates to such a regenerator checkerwork brick having hexagonally-shaped flow spaces disposed in a pattern for uniform and efficient accessibility to the heat storage mass of refractory.

The regenerator checkerwork brick of the present invention is useful for regenerators to extract heat from a fluid medium passing through the flow spaces in the brick in one direction and heat a different fluid medium when passing through the flow spaces in the opposite direction. While the regenerator checkerwork brick is useful for the operation of well known forms of blast furnace stoves, it is especially useful for horizontal regenerators of a blast furnace system such as disclosed in copending application Ser. No. 191,141 assigned to the same Assignee as this invention. In this blast furnace stove system, a recuperator is used for heating a cold air blast in heat exchange tubes with heat from a counter flow of waste products of combustion delivered from one of a plurality of horizontal regenerators. The preheated cold air blast is fed along horizontal flow spaces of highly-heated refractory in one of the regenerations. The resulting hot air blast is then fed to a hot blast main. The horizontal regenerator takes the form of a large cylinder arranged horizontally. This horizontal arrangement of the recuperator offers significant advantages over the older known forms of blast furnace stoves which embody a vertical flow path for combustion gases and an air blast. For either of these blast furnace stove arrangements, a desired efficient use of fuel requires a compact checker structure to provide a storage mass of nearly uniform accessibility for the storage and recovery of heat. The checkerwork should be readily adaptable to a circular configuration of a vessel for maximum density. Heat transfer efficiency of the checkerwork increases, when there is a greater density of checkerbrick surfaces transversely to the flow path for fluid media.

SUMMARY OF THE INVENTION

It is an object of the present invention to provide a compact checker structure for the storage and recovery of heat by transfer with fluids while flowing through checkerbrick having a geometrical configuration for nearly uniform accessibility to the storage mass by the provision checkerwall thickness that are nearly the same for all fluid-contacting surfaces to allow heating or cooling in a uniform manner.

It is a further object of the present invention to provide a hexagonal checker structure designed in a manner to eliminate ineffective or unusable heat storage refractory for a low ratio of weight-to-heat storage capacity.

It is another object of the present invention to provide a hexagonal checker structure having a hexagonal configuration of checker openings for a low fluid pressure drop relative to heat storage capacity.

It is still a further object of the present invention to provide a hexagonal checker structure with interlocking individual bricks in a manner to maintain alignment of fluid passageways under severe temperature and pressure conditions and structural integrity for either a horizontal or a vertical installation.

More particularly, according to the present invention there is provided a regenerator checkerbrick essentially including generally parallel internal planar wall sections surrounding a central flow space for a heat storage medium between two opposed sides of the brick, partitioning wall segments projecting radially from the internal wall sections, the internal wall sections and the partitioning wall segments having substantially uniform thicknesses, and planar exterior wall segments forming protruding sides from adjacent internal wall sections of an array of outer flow spaces distributed uniformly about the central flow space.

In its preferred form, the regenerator checkerwork brick of the present invention embodies a hexagonal configuration in which the central flow space has hexagonal wall surfaces and an array of outer flow spaces, preferably six such flow spaces, are distributed uniformly about the central flow space with each flow space defined by planar walls of hexagonal configuration. Internal walls forming flow spaces have a substantially uniform thickness which is about one-half the thickness of external walls. The abutment between adjacent bricks provides that essentially all flow spaces have substantially the same wall thickness. Two of the opposite lateral sides of each checkerbrick have a notched configuration for interlocking engagement with abutting checkerbrick while opposite lateral sides of the checkerbrick have protruding walls. When employed for a horizontal regenerator, the checkerbrick is preferably arranged such that the notched configuration to the outer side walls is in a vertical plane. The parting line between superimposed and underlined checkerbrick is offset from the vertical central plane of the individual checkerbrick. This avoids horizontal stresses, while at the same time, assures high heat transfer between all the various mating exterior faces of the checkerbricks.

These features and advantages of the present invention as well as others will be more fully understood when the following description of the preferred embodiment of the present invention is read in light of the accompanying drawings, in which.

Figure 1:
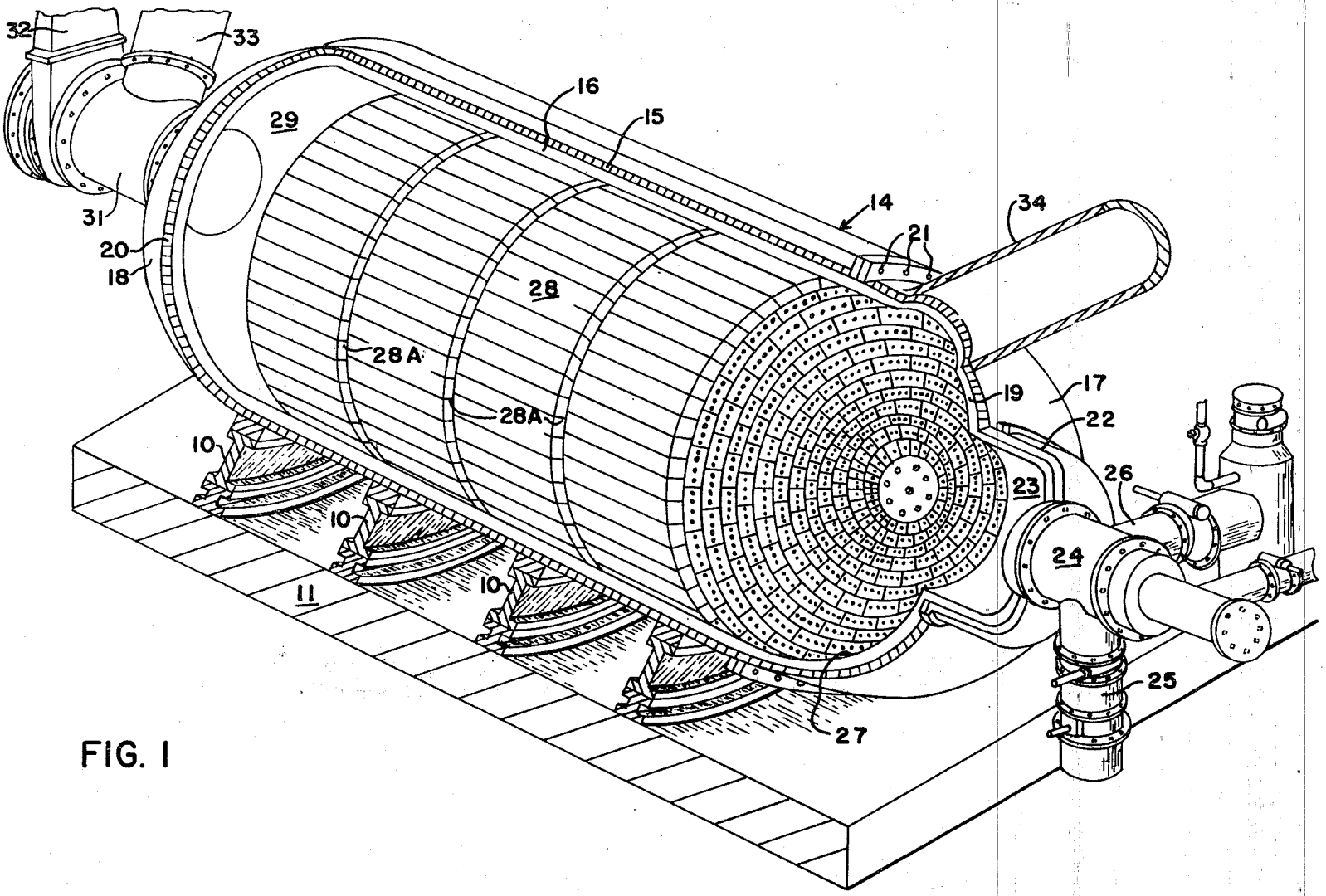
FIG. 1 is an isometric view of a horizontal regenerator in a hot blast stove system for a blast furnace.

In FIG. 1, there is illustrated one of a plurality, typically three, horizontally-arranged and mutually spaced-apart regenerators for a blast furnace stove system of the type shown in the aforesaid application Ser. No. 191,141. The regenerator is supported upon curved upper surfaces of upstanding pedestals 10 that rest on a suitable foundation 11. The regenerator takes the form of a cylindrical vessel 14 with an outer metal shell 15 and an inner lining of refractory material 16. The ends of the vessel are closed by dome-like end walls 17 and 18 each supporting an inner lining of refractory material 19 and 20, respectively. End wall 18 is typically attached to the body of the vessel by welding. A flange on end wall 17 and a flange on the body of the vessel are joined together by a series of bolt fasteners 21 for attaching end wall 17 to the vessel in a releasable manner. The end wall 17 has a centrally-arranged opening formed by protruding side walls 22 forming a cavity 23 communicating with a burner assembly 24. A conduit 25 feeds a supply of air and conduit 26 feeds a supply of gas to the burner assembly 24.

Figure 3:
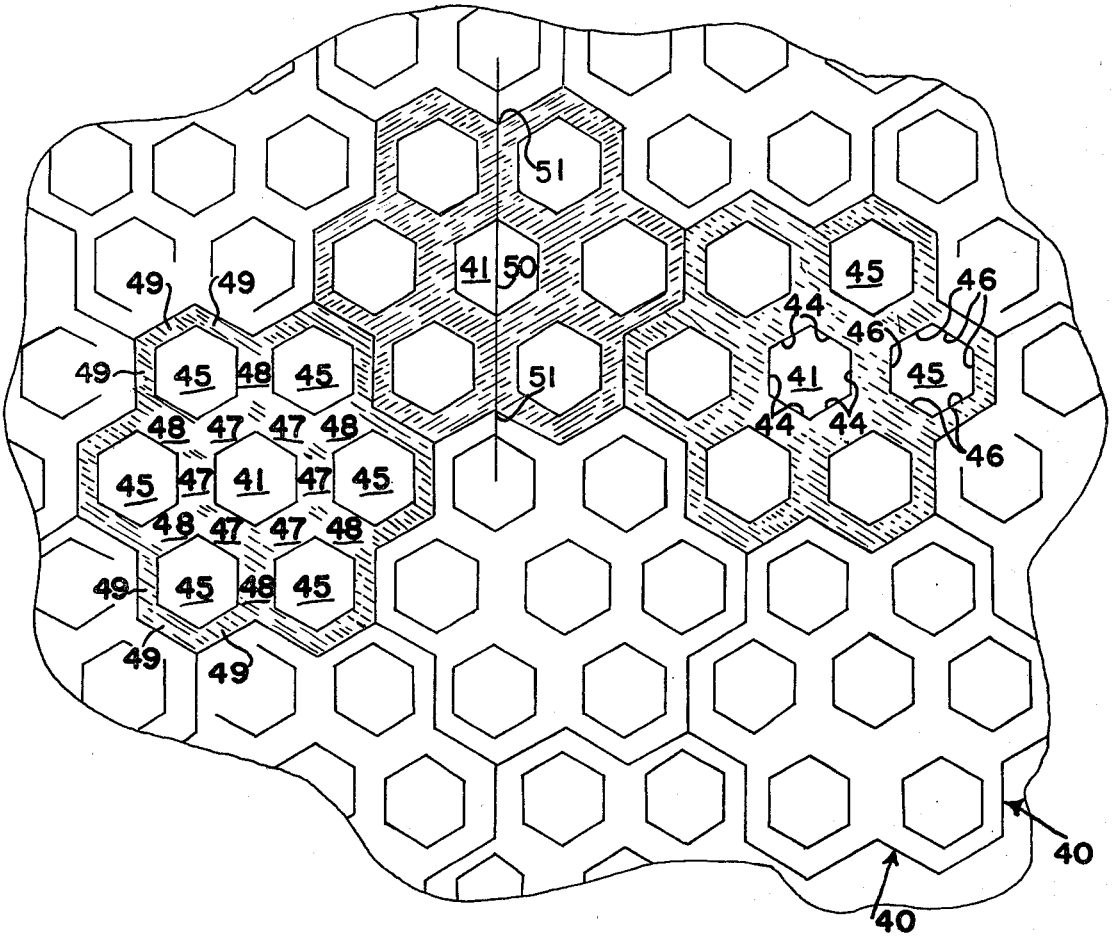
FIG. 3 is an enlarged elevational view showing an array of checkerbricks in the regenerator of FIG. 1.
Figure 2:
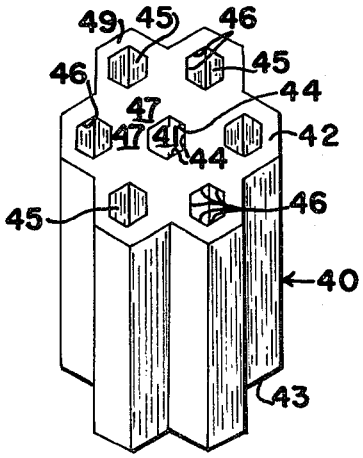
FIG. 2 is an isometric view of the preferred form of a regenerator checkerwork brick for use in the regenerator of FIG. 1 according to the present invention.

A chamber 27 extends from the end wall 17 a short distance along the horizontal axis of the regenerator to a body of heat storage refractory 28. Details of the refractory brick embodying the features of the present invention are shown in FIGS. 2 and 3 and will be described in detail hereinafter. The checkerwork of the body of refractory has horizontal passageways defined by openings extending through the checkerbrick and aligned. The body of refractory is preferably subdivided into a plurality of sections by arranging, at convenient vertical planes, the checkerbrick so that the confronting brick end walls are spaced apart to form spaces 28A. These spaces permit a lateral flow of hot products of combustion as well as a longitudinal flow along the regenerator. At different times, one or more but not all of a plurality of such regenerators is "ON GAS" during which fuel and air are delivered to the burner of each regenerator for combustion in space 27. The hot products of combustion flow along the horizontal passageways in the checkerbrick usually at about atmospheric pressure. The flow of combustion products through the mass of checkerbrick is continued until the checkerbrick is heated by sensible heat of the gases to a predetermined temperature. Waste combustion products are discharged from the mass of refractory checkerbrick into a collection chamber 29 that extends into the end wall 18 where a refractory-lined conduit 31 directs the gases to a feed pipe through an isolation valve 32 and thence to a header, not shown, for delivery to a recuperator.

After the refractory checkerbrick is heated to the predetermined desired temperature, the flow of air and gas to the burner 24 is terminated. The mode of operation is changed to "ON BLAST" in which preheated air from the recuperator is discharged through line 33 and conduit 31 into the space 29 of the regenerator. Valve 32 is closed when "ON BLAST". The blast of preheated air passes in the vessel along the flow spaces in the body of refractory material under a pressure of up to 50 psi. The air blast is heated to a temperature of, for example, 2000° F. or greater, for delivery from a chamber 27 by a hot blast delivery pipe 34.

In its preferred form, the checkerbrick of the checkerwork in the regenerator takes the form of a hexagonal checker structure in which each brick as shown in FIGS. 2 and 3 embodies a plurality of passageways. More specifically, a checkerbrick 40 is shown in which there is a central flow space 41 for the flow of heat exchange medium between opposite sides 42 and 43 of the brick. Six planar walls 44 are arranged in a hexagon configuration to form the central flow space 41. Six outer flow spaces 45 are distributed uniformly about the central flow space 41. Each outer flow space 45 is formed by six planar walls 46 arranged in a hexagon configuration. One wall surface 46 for each flow space 45 is parallel and oppositely directed from a wall surface 44 of flow space 41 and forms parallel boundaries to wall sections 47. The thickness of each of the wall sections 47 corresponds to the thickness of each of other wall sections 48 which project radially with respect to the central flow space 41. There are, of course, six wall sections 47 and six wall sections 48. There are three outer wall sections 49 for each of the flow spaces 45. Each wall section 49 has a thickness which is about one-half the thickness of a wall section 48. By this construction, the effective heat storage capacity provided by abutting exterior wall of two adjoined checkerbricks is substantially the same as a wall sections 47 or 48.

The checkerbrick are oriented in the regenerator so that a notch is formed by exterior walls of each brick in a vertical plane. In FIG. 3, reference numeral 50 identifies a vertical plane relative to an individual one of the checkerbricks. The brick is oriented such that the plane 50 extends along longitudinal notches at top and bottom sides of the brick. The notches are identified by reference numeral 51. At the opposite lateral sides of the bricks, protruding portions are formed by the angular arrangement of walls 49. The orientation of the checkerbrick in this manner provides that a projecting wall of two superimposed and abutting checkerbrick extends into the notch 51. The parting line between the superimposed checkerbrick is laterally displaced from the vertical plane 50. A similar arrangement occurs with respect to each underlying checkerbrick. At opposite lateral sides of each brick there are projecting planar and parallel faces of walls 49.

In view of the foregoing, it will be apparent to those skilled in the art that the hexagonal checkerbrick of the present invention conforms with a great degree of compatability for contact and support by a circular wall of the refractory-lined shell 15. The substantially uniform thickness to planar wall surfaces forming all of the internal flow spaces whether of a one-piece wall thickness or an aggregate of two abutting walls enhances the storage and recovery of heat by heat transfer to and from a flowing fluid medium. The hexagonal configuration provides a storage mass that is uniformly accessible for heat transfer because the thickness of the storage walls is the about same from all fluid contacting surfaces due to the hexagonal pattern of flow spaces and their juxtapositioning. In this way, the storage mass can be uniformly heated or cooled using essentially all the mass of the bricks. The regenerator checkerwork, therefore, provides a very low ratio of weight-to-heat storage capacity.

An annular flow space with an equivalent diameter of the hexagonal flow space has approximately 15% less wall surface. Therefore, the structure of the present invention provides a lower fluid pressure drop for the storage and recovery of heat. The planar wall surfaces to the flow spaces have the advantage over an annular flow spaces that a laminar flow condition is less likely to occur with planar face surfaces. A greater degree of turbulence in the fluid stream enhances conductive heat transfer.

The interlocking feature of the checkerbrick configuration assures accurate longitudinal alignment between the flow spaces of confronting checkerbrick. Such alignment is assured under severe temperature and pressure conditions; while at the same time, the structural integrity maintained in either a horizontal or vertical installation. The checkerbrick can be employed with equal success in the vertical arrangement of a regenerator section for a blast furnace stove. Such a vertical blast furnace stove is, per se, well known in the art and embodies a vertically-extending cylindrical shell made of metal and containing a lining of refractory material which is partitioned off by an internal breastwall. The larger area subdivided by the breastwall along a major part of the vertical height of the stove is filled with checkerbrick. Like the horizontal regenerator, a circular configuration exists where the checkerbrick of the present invention can be adapted for maximum density of flow space without undue loss of heat storage mass. The uniform thickness of the heat storage walls and the maximum utilization thereof by the hexagonal arrangement of flow spaces achieves a maximum storage for heat while at the same time reducing the load imposed on the checkerbrick near the bottom of the refractory as well as on the usual gridwork used to support the entire column of the checkerbrick.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Checkerwork bricks for a regenerator, each checkerbrick essentially including generally parallel internal planar wall sections surrounding a central flow space for conducting a heat exchange medium between opposite sides of the brick, partitioning wall segments projecting radially from said internal planar wall sections, said internal wall sections and said partitioning wall segments having substantially uniform thicknesses, and planar exterior wall segments of hexagonal configuration joined so that every three planar exterior wall segments form a flow space between each of adjacent ones of said internal wall sections to thereby form an array of outer flow spaces distributed uniformly about said central flow space, the thickness of said planar exterior wall segments being uniform and equal to about one-half the thickness of said internal wall sections so that each exterior wall segment of one brick can abut with a similar external wall segment of another brick to define an effective heat storage capacity of the two abutting walls substantially equal to the heat storage capacity of an internal planar wall section, each planar exterior wall segment being arranged to abut with an external wall segment of another brick for uniform heating or cooling of the mass of the brick by the flow of a heat transfer medium only along said central flow space and said outer flow spaces.

2. The regenerator checkerwork brick according to claim 1 wherein said central flow space is defined by six adjoined internal planar wall sections.

3. The regenerator checkerwork brick according to claim 1 wherein said planar exterior wall segments define diametrically-opposite outer flow spaces.

4. The regenerator checkerwork brick according to claim 3 wherein said partitioning wall segments extend radially at diametrically-opposite sites to form a corner of a pocket recess with oppositely-directed and outwardly-protruding ones of said planar exterior wall segments.

5. The regenerator checkerwork brick according to claim 1 wherein diametrically-opposite sides of said brick have symmetrically-arranged pockets and perpendicularly thereto diametrically-opposite sides of said brick have projecting planar and parallel faces defined by two of said planar exterior wall segments.

* * * * *